US005556087A

United States Patent [19]

Gösslinghoff

[11] Patent Number: 5,556,087

[45] Date of Patent: Sep. 17, 1996

[54] APPARATUS FOR PROCESSING PRINTED PRODUCTS

[75] Inventor: Reinhard Gösslinghoff, Wetzikon, Switzerland

[73] Assignee: Ferag AG, Switzerland

[21] Appl. No.: 451,193

[22] Filed: May 26, 1995

[30] Foreign Application Priority Data

May 31, 1994 [CH] Switzerland ..... 01692/94

[51] Int. Cl.[6] ..... B65H 39/045; B65H 39/105

[52] U.S. Cl. ..... 270/58.18; 271/295; 271/315

[58] Field of Search ..... 270/58.21, 58.19, 270/58.18, 58.2; 271/295, 315

[56] References Cited

U.S. PATENT DOCUMENTS

| | | | |
|---|---|---|---|
| 2,589,676 | 3/1952 | Crissy | 270/58.19 X |
| 3,540,721 | 11/1970 | Blowsky | 270/58.21 |
| 3,796,422 | 3/1974 | Blowsky | 270/58.21 |
| 3,951,399 | 4/1976 | Reist | 270/58 |
| 4,058,202 | 11/1977 | Reist et al. . | |
| 4,127,262 | 11/1978 | Eberle et al. . | |
| 4,168,057 | 9/1979 | Fassman et al. | 270/58.21 |
| 4,279,412 | 7/1981 | Glatz . | |
| 4,416,448 | 11/1983 | Meier . | |
| 4,537,391 | 8/1985 | Watkiss et al. . | |
| 4,735,406 | 4/1988 | Weber | 270/58 X |
| 4,813,622 | 3/1989 | Nidiffer et al. . | |
| 4,867,429 | 9/1989 | Infanger . | |
| 4,928,945 | 5/1990 | Soderberg et al. . | |
| 4,981,291 | 1/1991 | Honegger et al. . | |
| 4,988,086 | 1/1991 | Schlough . | |
| 5,046,711 | 9/1991 | Merwarth et al. | 271/315 X |
| 5,052,666 | 10/1991 | Hansch . | |
| 5,094,438 | 3/1992 | Reist et al. . | |
| 5,104,108 | 4/1992 | Honegger . | |
| 5,106,070 | 4/1992 | Reist . | |
| 5,277,413 | 1/1994 | Boss | 271/315 X |
| 5,377,967 | 1/1995 | Eberle . | |
| 5,398,920 | 3/1995 | Leu . | |

FOREIGN PATENT DOCUMENTS

| | | |
|---|---|---|
| 0031717 | 7/1981 | European Pat. Off. . |
| 0384119 | 8/1990 | European Pat. Off. . |
| 3200594 | 7/1983 | Germany . |
| 3616566 | 12/1986 | Germany . |
| 637087 | 7/1983 | Switzerland . |
| 2046717 | 11/1980 | United Kingdom . |

*Primary Examiner*—John E. Ryznic
*Attorney, Agent, or Firm*—Brinks Hofer Gilson & Lione

[57] ABSTRACT

The apparatus for processing printed products includes receiving compartments that are arranged one behind the other in the direction of rotation and are moved, with their outer opening, past the discharge end of a belt conveyor. Arranged at the opening of each receiving compartment is a conveying-roller pair that is intended, upon moving past the discharge end, to grasp between its rollers one printed product that has been fed by the belt conveyor and to clamp printed product in the conveying gap. During further movement of the receiving compartment in the direction of rotation, the firmly clamped printed product is conveyed into the receiving compartment. This permits reliable introduction of the printed products into the receiving compartments, even if said printed products are fed at different spacings.

12 Claims, 5 Drawing Sheets

APPARATUS FOR PROCESSING PRINTED PRODUCTS

BACKGROUND OF THE INVENTION

The present invention relates to an apparatus for processing printed products having continuously rotating receiving compartments arranged one behind the other. The receiving compartments are separated by transversely extending walls and each compartment has an opening through which printed products are deposited from a belt conveyors.

An apparatus of this general type is disclosed in U.S. Pat. No 3,951,399 and the corresponding DE-A-24 47 336. This apparatus includes receiving compartments that are arranged in the manner of a drum around a common horizontal axis of rotation. The receiving compartments are separated from one another by wall elements running in the direction of the axis of rotation. Each receiving compartment includes an opening that is on the outside, as seen in the radial direction. Printed products can be introduced into the receiving compartments through these openings. The discharge end of a belt conveyor is arranged above the axis of rotation. The discharge end of the belt conveyor is located on the side of a vertical plane extending through said axis of rotation, that the receiving conveyors are moving in the direction from top to bottom. Printed products are fed along the belt conveyor in an approximately horizontal direction to the discharge end in an imbricated formation in which each printed product rests on the preceding printed product. At the discharge end, each printed product is discharged from the belt conveyor, leading edge first, and falls through the opening into the receiving compartment that is moving past the discharge end. This prior art apparatus relies on the spacing between the leading edges of successive printed products being kept constant, within narrow limits, to insure that one printed product is fed to each receiving compartment moving past the discharge end. The feed of the printed products must be at least approximately synchronized with the drive of the receiving compartments.

Another apparatus of this general type is disclosed in U.S. Pat. No. 4,735,406 and the corresponding DE-A-36 16 566. This drum like collecting apparatus includes a plurality of carriers that rotate around a common axis of rotation and are arranged at regular intervals around the axis of rotation in the circumferential direction. In feeding sections of the drum-like collecting apparatus, each carrier has a corresponding pocket-like receiving compartment that is on the outside of the carrier, as seen in the radial direction. The pocket-like receiving compartments rotate around the axis of rotation with the carrier. The pocket-like receiving compartments include a first wall element that extends generally radially and parallel to the axis of rotation and a second wall element that precedes the first wall element in the direction of rotation. The wall elements taper in the form of a wedge toward the carrier. A belt conveyor extends generally radially with respect to the axis of rotation. The openings of the pocket-like receiving compartments move past the discharge end of said belt conveyor with respect to a vertical plane that extends through the axis of rotation, on that side in which the pocket-like receiving compartments are moving from bottom to top. Printed products are arranged on the belt conveyor in an imbricated formation in which the printed products rest on the respectively following printed product, as seen in the feeding direction. The belt conveyor deposits into each pocket-like receiving compartment a folded printed product with that end in front that is located opposite the fold. The following wall element of the pocket-like receiving compartments raise the printed product up from the imbricated stream. Upon further rotation of the pocket-like receiving compartments, the printed product slides inward in the radial direction until it rests with its leading edge against a shoulder of an expansion drum. By rotation of the expansion drum, along with interaction with a gripper, the printed product is drawn downwards and opened and pushed over the carrier, and the printed product falls onto the carrier under the force of gravity. In this prior art apparatus, it is necessary for the spacing between the leading edges of successive printed products to be kept within narrow limits. Moreover, the overlapping of the printed products in the imbricated formation must be small in order that they can be conveyed into the pocket-like receiving compartment, by the belt conveyor, to such an extent that they do not fall out of the pocket-like receiving compartments when they are raised up from the imbricated formation. These limitations of the prior art apparatus requires large openings in the pocket-like receiving compartments, as seen in the circumferential direction, that, in turn, restricts the possible number of receiving compartments when using the same diameter of processing drum.

For the foregoing reasons, there is a need for an apparatus of this type that can operate reliably to receive a printed product in each receiving compartment through relatively small openings under operating conditions in which the leading edges of the successive printed products are not contained within narrow limits.

SUMMARY OF THE INVENTION

An object of the present invention is to provide an apparatus of the type that can process a greater volume of printed products while ensuring reliable processing of the printed products with a considerable variation in the spacing of the leading edges of successive printed products.

The apparatus of this invention comprises a rotary drum having a plurality of receiving compartments each having relatively narrow receiving openings, thus increasing the number of receiving compartments.

The present invention also comprises a conveying-roller pair, adjacent the opening of each receiving compartment, that form a conveying gap.

The present invention also includes a conveying-roller pair that includes at least one driven roller that moves over the discharge end of the belt conveyor to grasp a printed product.

The present invention further includes a conveying-roller pair that moves over the discharge end of the belt conveyor to clamp the printed product and convey the firmly clamped printed product into the receiving compartment.

The printed products, fed with their leading edge in front, are seized, and conveyed into the receiving compartments, by means of a conveying-roller pair. In accordance with this invention it is not important how far the printed products are introduced into the receiving compartments by means of the belt conveyor since they will be seized by the conveying-roller pair. Seizing of the printed products, irrespective of the spacing, and actively conveying the printed products into the receiving compartments, is performed by the conveying-roller pairs associated with the receiving compartments.

The discharge end of the belt conveyor can be located at virtually any location along the movement path of the openings. Since the fed printed products are actively conveyed into the receiving compartments, the belt conveyor may be horizontal, ascending or descending.

As a result of the conveying-roller pair, actively grasping the printed product, the opening in the receiving compartments can be narrow and a larger number of receiving compartments can be provided.

A preferred embodiment of the apparatus according to the invention includes a conveying-roller pair, thus ensuring that printed products are seized reliably in a vast range of different positions.

BRIEF DESCRIPTION OF THE DRAWINGS

The present invention will now be explained in more detail with reference to the following drawings.

DETAILED DESCRIPTION OF THE PREFERRED EMBODIMENTS

Figure 1:
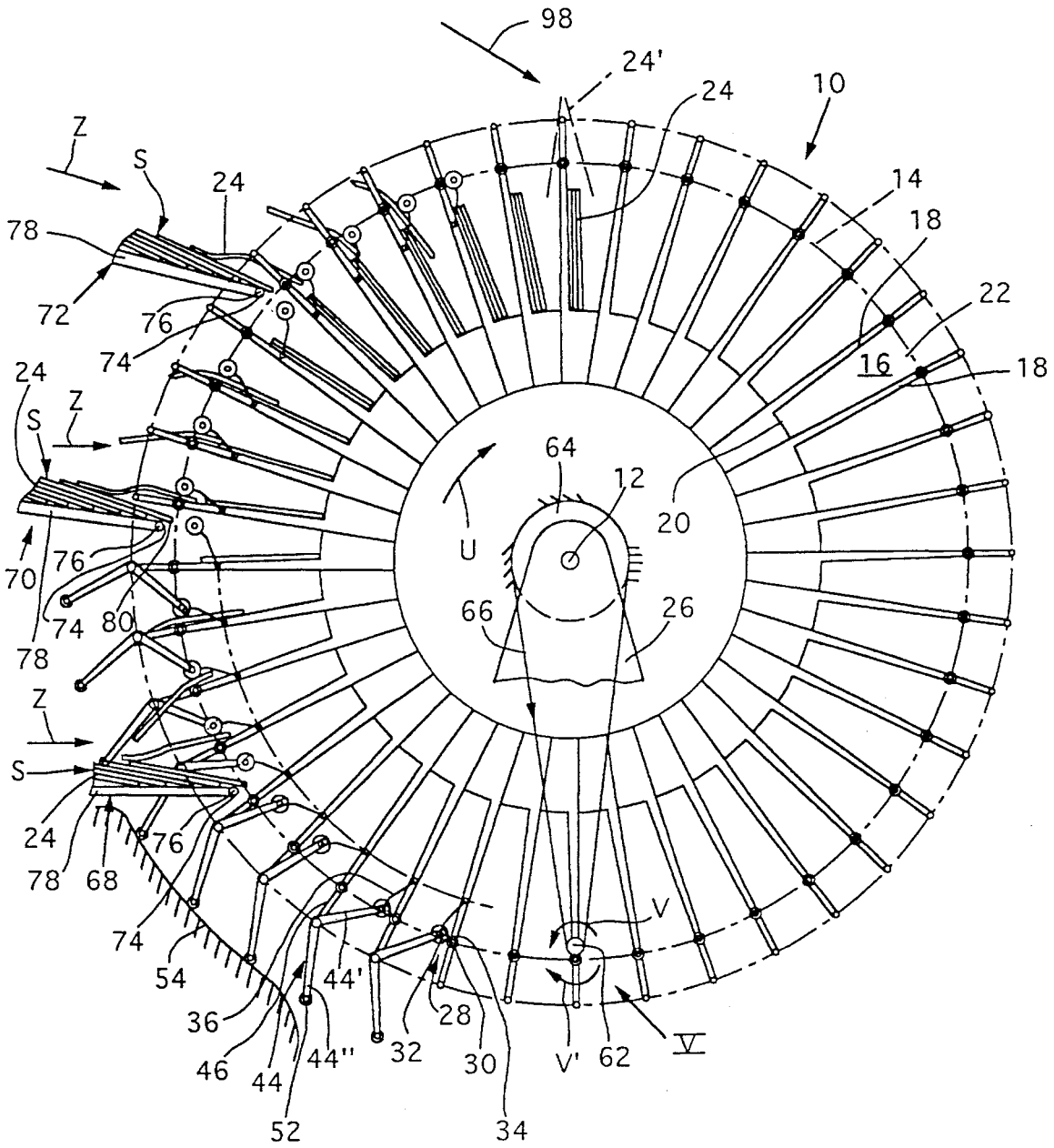
FIG. 1 shows, in a very simplified manner, a cross-section through an apparatus according to the invention, having three belt conveyors arranged one above the other and a processing drum with receiving compartments that, at their opening, exhibit a conveying-roller pair in order to seize the printed products fed by the belt conveyors and to convey them into the receiving compartments.

The apparatus shown in the Figures discloses a processing drum 10 with receiving compartments 16 that are arranged around a common axis of rotation 12. The receiving compartment rotates around the axis of rotation together along a circular path 14. The receiving compartments 16 are separated from one another by wall elements 18, that extend longitudinally of the processing drum 10 and in the radial direction relative to the axis of rotation 12. The wall elements 18 are distributed uniformly around the circumference of the processing drum 10 and the receiving compartments are closed by a base 20 that is located between the periphery and the center of the processing drum 10. Each receiving compartment 16, has at its periphery an opening 22 that extends circumferentially from one wall element 18 to the next. The openings 22 extend in the axial direction, at least a length that is greater than the dimension of the largest printed products 24 to be processed. Preferably, the openings 22 extend essentially over the entire length of the processing drum 10. To complete the picture, it should be mentioned that, as is known in general, conveying means may be assigned to the receiving compartments 16 in order, during the revolutions of the processing drum 10, to displace in a stepwise manner, in the direction of the axis of rotation 12 of said processing drum 10, those printed products 24 that have been introduced into the receiving compartments 16.

The processing drum 10 is mounted rotatably on a machine framework 26, of which only a very small part is shown, and is continuously driven in rotation in the direction of rotation U.

Arranged at the opening 22 of each receiving compartment 16 is a conveying-roller pair 28, of which the rollers 30, 32 run parallel to the axis of rotation 12 of the processing drum 10 and form a conveying gap 34 that runs approximately in the radial direction.

A roller is mounted in a freely rotatable manner at the radially outer end of each wall element 18; said roller forms the respectively first roller 30 of a conveying-roller pair 28. The second roller 32, that in each case precedes said first roller 30 in the direction of rotation U, of a conveying-roller pair 28 is arranged, at both ends, on the wall element 18 via a single-armed bearing lever 36. The pivotable articulation of the bearing levers 36 on the wall element 18 is offset inward in the radial direction with respect to the corresponding first roller 30. The bearing levers 36 are pre-stressed in the direction of the arrow A by means of a spring element 38 in order to force the second roller 32 towards the first roller 30, into a pressing-on position 40.

The bearing levers 36 are each coupled to an angled-off, two-armed control lever 44 that is mounted on a radial extension arm 46 of the respectively preceding wall element 18, as seen in the direction of rotation U. In the free end region, the inner lever arm 44' of the control lever 44 exhibits a slot-like through-passage 48 into which the bearing journal 50 of the second roller 32 engages, the latter being mounted in a freely rotatable manner on the bearing lever 36 by means of said bearing journal 50. Mounted in a freely rotatable manner at the free end of the outer lever arm 44" of the control lever 44 is a control roller 52. Control roller 52 interacts with a stationary guide 54 that is arranged outside the processing drum 10, as seen in the radial direction, in order to move the second roller 32 from the pressing-on position 40. The second roller 32 is thus moved counter to the direction of arrow A and in dependence on the rotary position of the processing drum 10, into a raised-up position 40' represented by broken lines in FIG. 2. In said raised-up position 40', the second roller 32 is located in the vicinity of the preceding wall element 18 and forms, between it and the first roller 30, a gap that is considerably wider than the thickness of the printed products 24 to be processed. The bearing lever 36, the spring element 38, the control lever 44 with the control roller 52, and the guide 54 form a control device 55.

Figure 3:
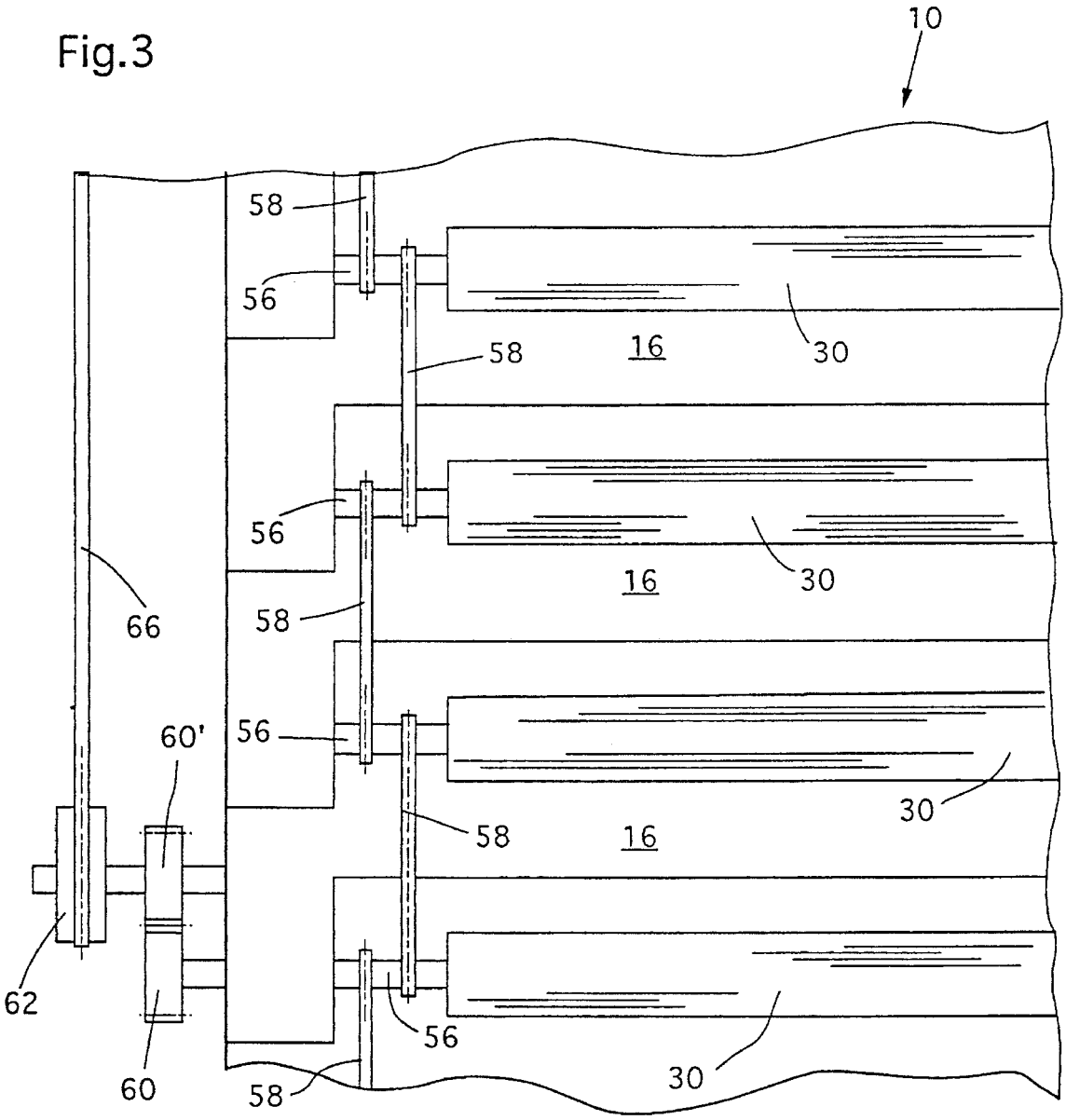
FIG. 3 shows, on a larger scale than FIG. 1, part of the processing drum, said part being designated by V, having a device for driving in each case one roller of the conveying-roller pairs.
Figure 4:
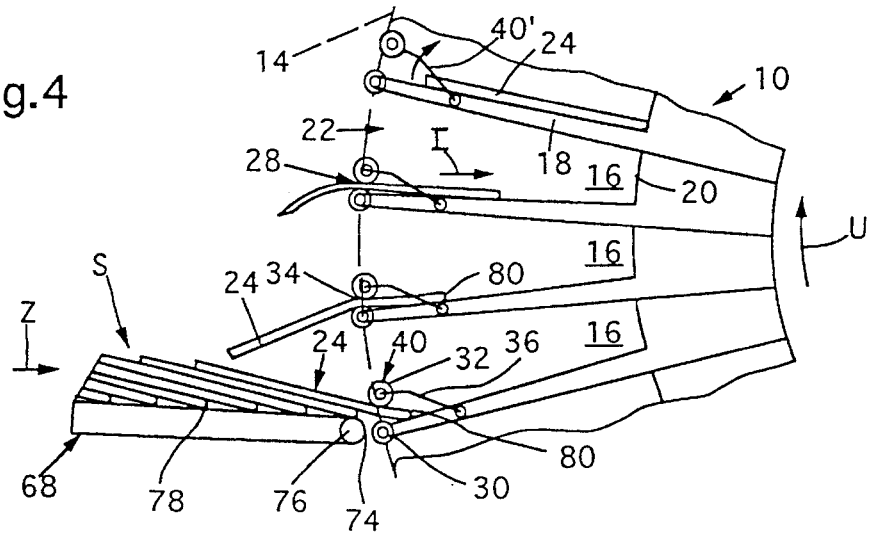
FIGS. 4–6 show part of the apparatus shown in FIG. 1, at three points in time, that are spaced apart by a third of an operating cycle, upon the introduction of printed products into the receiving compartments.
Figure 5:
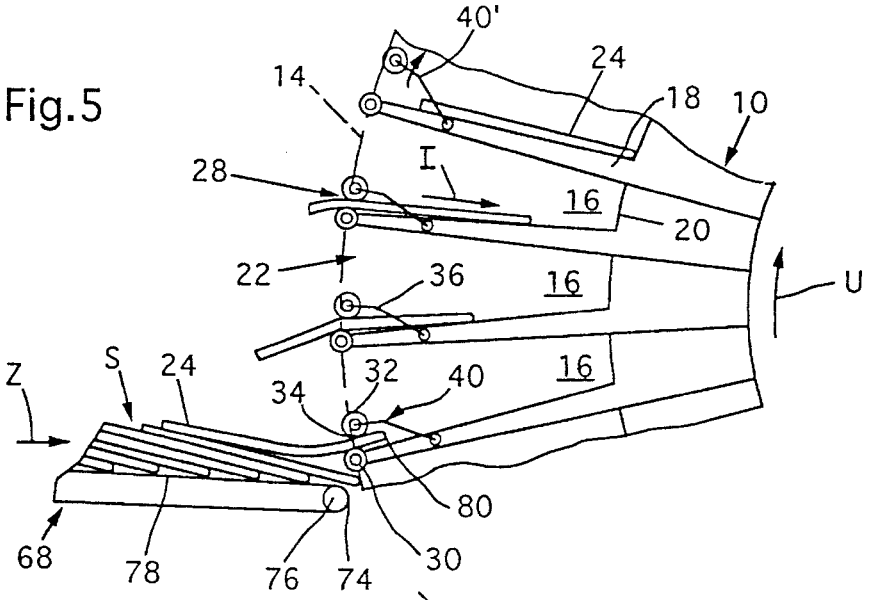
Figure 6:
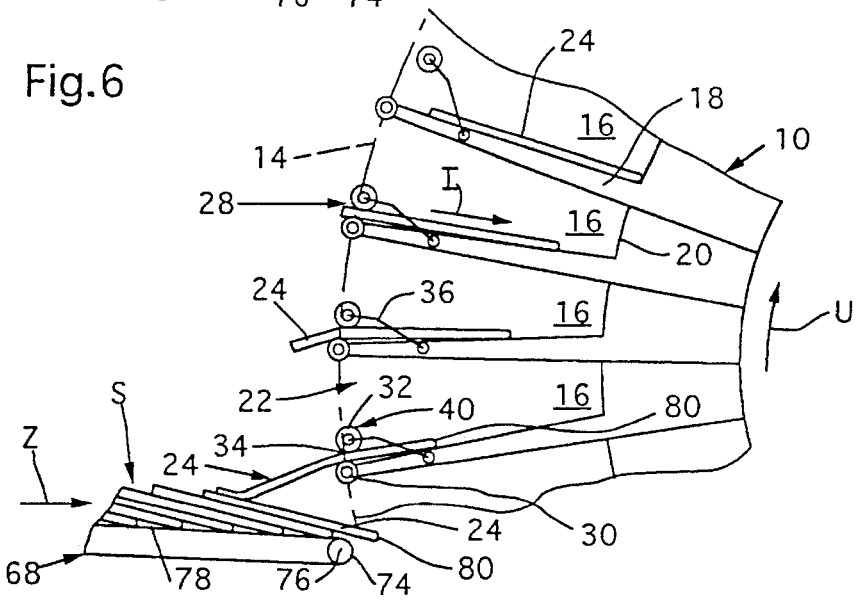

The first rollers 30 are rotatably driven in the clockwise direction in order to convey, in the direction of arrow I, into the receiving compartments 16 those printed products 24 that are clamped in the conveying gap 34 between the first and second rollers 30, 32. The drive of the first rollers 30 can be seen in FIG. 3. An endless drive belt 58 is guided around the bearing shafts 56 of adjacent first rollers 30. The drive belts 58, arranged in series, thus connect all the first rollers 30 to one another. The bearing shaft 56 of one of the first rollers 30 projects beyond the wall element 18, and carries a spur gear 60 at its free end. The spur gear 60 meshes with a second spur gear 60' that is carried by a shaft that is mounted on the same wall element 18 and also carries a drive wheel 62. An endless belt 66 or the like is guided around drive wheel 62 and a second drive wheel 64, see FIG. 1, that is fixedly arranged on the machine framework 26 coaxially with respect to the axis of rotation 12. Upon rotation of the processing drum 10 in the direction of rotation U about the axis of rotation 12, the belt 66 runs around the fixed second drive wheel 64, as a result of which the drive wheel 62 is driven counter to the direction of rotation U (arrow V). As a result of the meshing spur gears 60, 60', the rotational direction of the first rollers 30 is reverse (arrow V').

With respect to a vertical plane that extends through the axis of rotation 12, three belt conveyors 68, 70, 72 are arranged one above the other on the left-hand side in FIG. 1. The discharge ends 74 of belt conveyors 68, 70, 72 are located in the vicinity of the movement path 14 of the first rollers 30 around the axis of rotation 12. The belts 78 of belt conveyors 68, 70 and 72 are each guided at their discharge end 74 around a stationary deflection roller 76. The belts 78 are driven in the feeding direction Z in order to feed the printed products 24, carried by belts 78, to the receiving compartments 16 of the processing drum 10. The printed products 24 are arranged in an imbricated formation S in which each printed product 24 rests on the respectively following printed product. The control lever 44 and bearing lever 36, as seen looking along the axis of rotation 12, are located outside the region of the belt conveyors 68 and of the printed products 24 carried thereby.

As can be seen in FIG. 1, the belt conveyors 68, 70, 72 are orientated approximately horizontal. Central belt conveyor 70 is approximately level with the axis of rotation 12. The discharge ends 74 of the bottom belt conveyor 68 and top belt conveyor 72 are arranged such that a straight line connecting said discharge ends 74 to the axis of rotation 12 and a straight line connecting said axis of rotation 12 to the discharge end 74 of the central belt conveyor 70 enclose an angle of approximately 30°. It should, however, be mentioned that said belt conveyors 68, 70, 72 may also be arranged closer to one another or further apart from one another, or that, depending on requirements, a greater number or lesser number of belt conveyors could be used. If appropriate only one belt conveyor need be used. It is also contemplated in accordance with this invention to arrange the belt conveyors, in particular those beneath the level of the axis of rotation 12, in an ascending manner and, those above the level of the axis of rotation 12, in a descending manner.

Each of the belt conveyors 68, 70, 72 is intended to introduce a printed product 24 with its leading edge 80, as seen in the feeding direction Z, in front into each receiving compartment 16 moving past the discharge end 74 of the belt conveyors. The printed products are thus inserted between the raised-apart rollers 30, 32. This procedure will now be discussed in more detail with reference to FIGS. 2 and 4–6.

Figure 2:
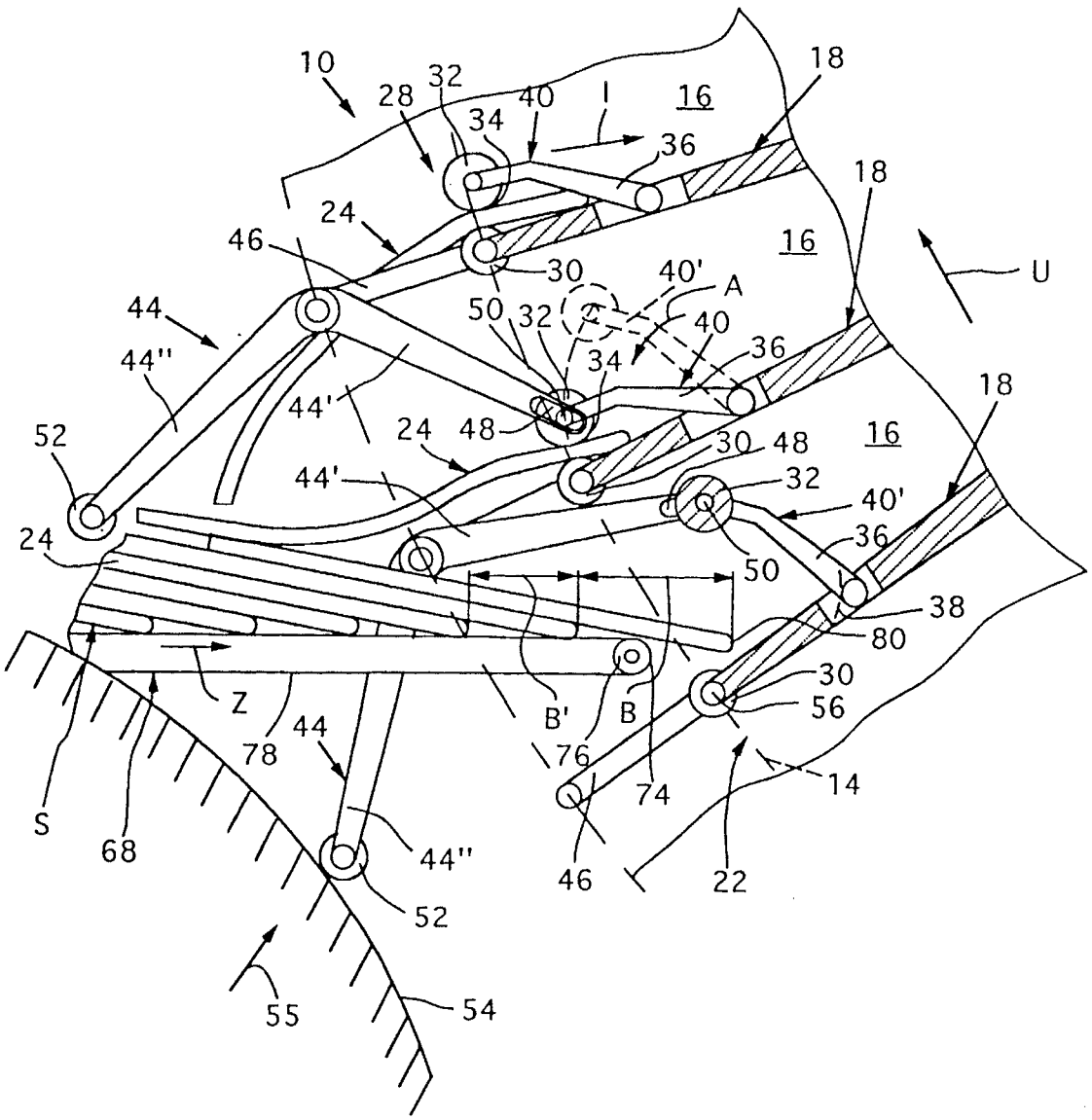
FIG. 2 shows, on a larger scale than FIG. 1, part of the apparatus shown in FIG. 1.

A stationary guide 54 is arranged upstream of each belt conveyor 68, 70, 72, as seen in the direction of rotation U. In FIG. 1 only the guide 54 that is associated with the lowermost belt conveyor 68 is illustrated. When the second rollers 32 approach the discharge ends 74 of the belt conveyors, they are transferred from the pressing-on position 40 into the raised-up position 40'. The belt conveyors 68, 70, 72 are driven continuously in synchronization with the processing drum 10, with the result that a printed product 24 is introduced, with its leading edge 80 in front, into each receiving compartment 16. The printed products 24 are inserted between the raised-apart first and second rollers 30, 32, as can be seen from the lowermost receiving compartment 16 shown in its entirety in FIG. 2. The respectively following first roller 30 engages beneath the corresponding printed product 24 and, when said first roller 30 runs past the discharge end 74 of the relevant belt conveyor 68, 70, 72, the second roller 32 is pivoted in the direction of arrow A into the pressing-on position 40 in order to clamp the printed product 24 firmly in the conveying gap 34. By adjusting the guide 54, the precise location at which the second rollers 32 move into the pressing-on position 40, under the action of the spring element 38, can be determined. This position is shown in FIG. 2 by the central receiving compartment, and by the lowermost receiving compartment in FIG. 4. Upon further rotation of the processing drum 10, the printed product 24 that is now clamped firmly in the conveying gap 34 is conveyed in the arrow direction I towards the interior of the receiving compartment 16, as a result of the driven first roller 30. The printed product 24 is simultaneously raised upwards from the imbricated formation S. The discussion of this process is best understood with reference to the receiving compartments 16 seen at the bottom of FIGS. 5 and 6.

The first rollers 30 are driven at a circumferential speed such that the printed products 24 are fully conveyed into the receiving compartment 16 before the relevant receiving compartment 16 reaches the discharge end 74 of the next belt conveyor 70 or 72. When the next belt conveyor 70 or 72 is encountered, an additional printed product 24 is inserted in the same manner into the receiving compartment 16. The additional printed product 24 will lie flat on the printed product 24 already located in the receiving compartment 16. In this manner, the printed products 24 are collated.

Printed products 24 that have been fed by the belt conveyors 68, 70, 72 in the same manner may be inserted into a folded, open printed product that has its fold resting on the base 20. The folded, open printed product could be, for example, a cover or a main printed product. Such introduction, and opening, of printed products in a drum-like processing apparatus is disclosed, for example in U.S. Pat. No. 3,951,399 and corresponding DE-A-24 47 336. U.S. Pat. No. 3,951,399 is hereby included by reference as a part of this disclosure.

In FIG. 2, the spacing between the leading edge 80 of three successive printed products 24 is designated by B and B'. As illustrated, these spacings are different. However, they could also be the same. The only critical condition is that the variance must be within the limits that will ensure that the printed products 24 will be introduced between the conveying-roller pair 28 of each receiving compartment 16 and the relevant first roller 30 can move past the leading edge 80 of the next printed product 24. It is not critical how far a printed product 24 is conveyed into the receiving compartment 16 by means of the belt conveyor 68, 70, 72. The printed products 24 must be inserted to an extent that, when the second roller 32 is transferred into the pressing-on position 40, the printed product 24 is located in the conveying gap 34 by at least a border region adjoining the leading edge 80. Provided this minimum condition is met, the relevant printed product 24 can be reliably seized and clamped firmly by means of the conveying-roller pair 28. If a printed product 24 is pushed further into the receiving compartment 16, then, when the second roller 32 is transferred into the pressing-on position 40, it is clamped firmly in a region that is correspondingly further away from the leading edge 80. This will not result in damage to the printed products 24 since, in the radial direction, the distance between the conveying-roller pair 28 and the base 20 is greater than the extent of the printed products 24 in this direction.

The belt conveyors could also be arranged on the other side, with respect to a vertical plane passing through the axis of rotation 12. In this case, the printed products 24 rest on the belt conveyor in an imbricated formation in which each product rest on the preceding product, as seen in the feeding direction Z, and is overlapped by the following printed product 24. The printed product 24 that is seized by the conveying-roller pair 28 is drawn away downwards from beneath the following printed product 24. The leading edge 80 of the following printed product 24 is thus freed for the introduction into the following receiving compartment 16.

Figure 7:
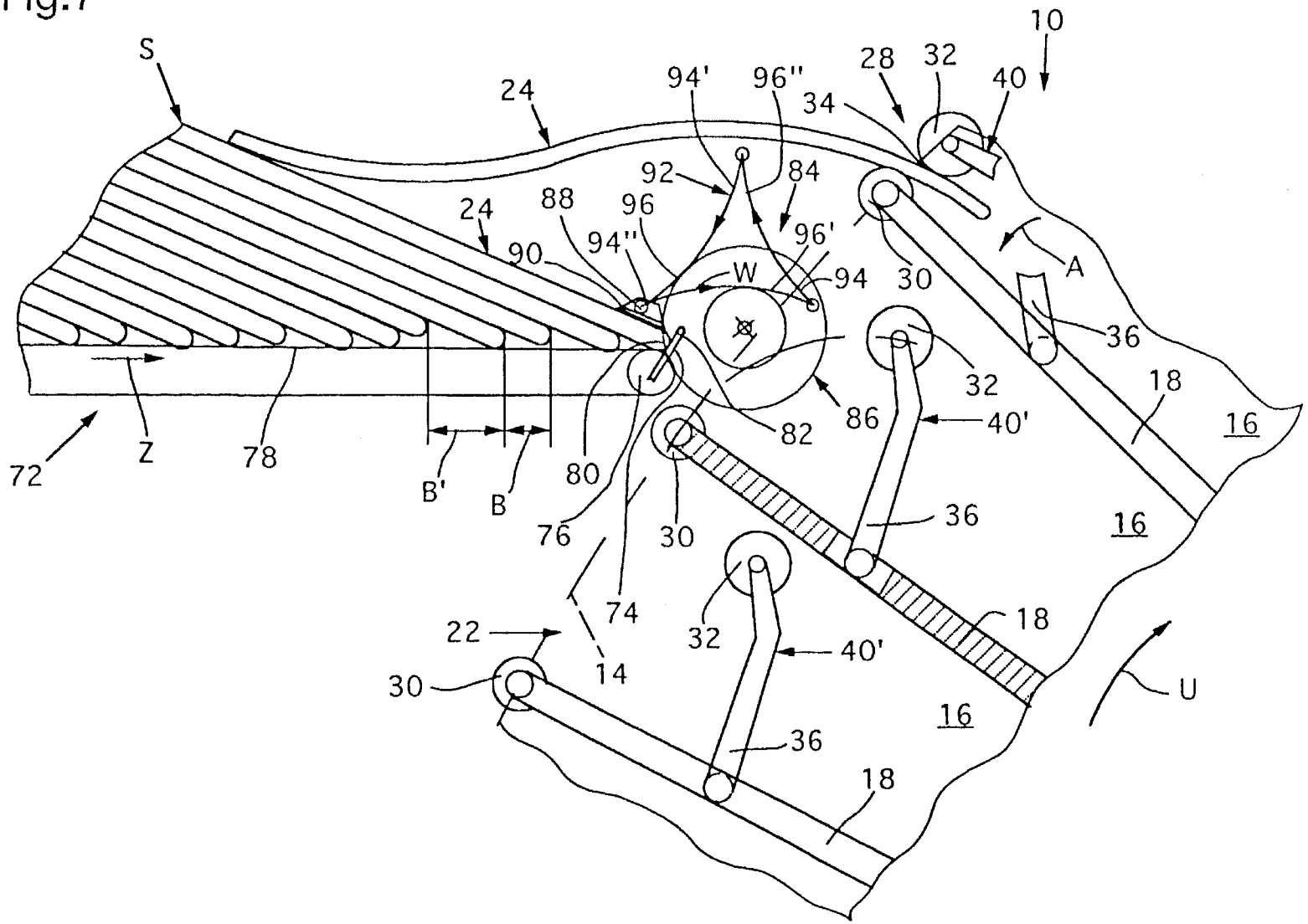
FIG. 7 shows, in the same representation as FIG. 2, a further embodiment of the apparatus according to the invention, having a suction-head arrangement that is arranged at the discharge end of the belt conveyor and is intended for introducing in each case one printed product between the rollers of a conveying-roller pair.

FIG. 7 shows, in the same representation as FIG. 2, part of the processing drum 10 and of the uppermost belt conveyor 72. For the sake of clarity, the control device 55 for controlling the position of the second roller 32 is not illustrated in this Figure.

There is a stop 82 arranged at the discharge end 74 that projects into the conveying path of the leading edge 80 of the printed products 24. The printed products rest on the belt 78 of the belt conveyor 72 in an imbricated formation S in which each printed product 24 bears on the following printed product 24. In comparison with the imbricated formation S shown in FIG. 2, the spacing B, B' on average, here between the leading edge 80 of successive printed products 24 is smaller. However, as illustrated in FIG. 7, the spacings may also be different.

Furthermore, a suction arrangement 84 is arranged at the discharge end 74, This suction arrangement is of the type disclosed, for example, in U.S. Pat. No. 4,279,412 and the corresponding CH-A-626 589, U.S. Pat. No. 5,377,967 and the corresponding EP-A-0 553 455 application and U.S. Pat. No. 5,398,920 and the corresponding EP-A- 0 551 601. U.S. Pat. Nos. 4,279,412, 5,377,967 and 5,398,920 are hereby included by reference as a part of this disclosure.

There is arranged at the end of a suction arm 88 that is connected to a suction drive 86 a suction head 90 that can be connected to a vacuum source via a valve arrangement. The suction drive 86 is offset with respect to the conveying-roller pair 28, seen in the direction of the axis of rotation 12, and the suction arrangement 84 engages, solely with the suction arm 88 and suction head 90, into the movement region of the wall elements 18 and of the conveying-roller pair 28. The suction arrangement 84 is intended to seize the foremost printed product, that is resting against the stop 82, at its surface in the vicinity of the leading edge 80 and in the vicinity of the side edge directed towards the suction arrangement 84. The suction drive 86 functions to raise up the printed product over the stop 82, into a receiving compartment 16, where the printed product 24 is released by providing the suction head 90 with pressurized air. Upon subsequent transfer of the second roller 32 into the pressing-on position 40, the printed product 24 is seized by the conveying-roller pair 28 in order to convey it further into the receiving compartment 16. A preferred, approximately triangular circulation path for the suction arm 88 and suction head 90 is designated by 92. A pointed section 94 of the circulation path 92 lies, with respect to the axis of rotation 12, radially within the movement path 14 of the first roller 30, while the other two pointed sections 94', 94" and the chord 96 connecting pointed sections 94', 94" are located outside the movement region of the processing drum 10. The suction arm 88 and the suction head 90 are located outside the section 94 when a wall element 18 moves past the suction arrangement 84.

For the introduction into the receiving compartment 16 of the printed product 24 resting against the stop 82, the suction head 90 that retains the printed product 24 is moved in the direction of the arrow W, along the chord 96', to the section 94. The chord 96' lies in a plane that is at a right angle to the axis of rotation 12. When the suction head 90 has reached the point of the circulation path 92 in the section 94 it is provided with pressurized air that functions to release the printed product 24. Upon subsequent movement of the suction head 90 along the chord 96", it is also moved along the direction of the axis of rotation 12 to a location outside the region of the printed product 24, that has been grasped by the conveying-roller pair 28, in order to bypass the side edge. After the suction head 90 moves through the chord 96, it is then moved in the opposite direction between the printed product 24 that has been raised up from the imbricated formation S. The next printed product 24 now rests against the stop 82, and the suction head 90 is positioned against the free upper flat surface of this next printed product 24. The suction head 90 is connected to the vacuum source, to introduce this printed product 24 in the same manner between the conveying-roller pair 28 of the following receiving compartment 16.

In order to move the suction head 90 in the direction of the axis of rotation 12, the suction drive 86, for example, may be mounted in the manner of a carriage such that it can be displaced in the direction of the axis of rotation 12 and may be moved back and forth by well known drive elements.

In FIG. 1, the arrow 98 indicates a feeding station that is intended to deposit an additional folded printed product 24', in the opened state, in a straddling manner over the printed products 24 that have been collated as previously described.

In the exemplary embodiments of the present invention that have been shown, the receiving compartments 16 move along a circular movement path 14 around the axis of rotation 12. It is, however, also conceivable to move the receiving compartments 16 along an elongate circulating conveyor.

It is also contemplated by this invention that, instead of driving the first roller 30 of a conveying-roller pair 28, the second roller 32 or even both rollers 30 and 32 could be driven in order to convey the printed products 24 into the receiving compartment 16. In addition, the rollers 30, 32 do not have to be driven continuously. It is sufficient if they are driven from the moment of transfer into the pressing-on location 40 until the introduction of a printed product 24 into the receiving compartment 16 is complete.

It is also contemplated by this invention, that the control device 55 for the conveying-roller pair 28 could be of a different design. It is thus conceivable to provide the control elements within the processing drum 10.

It is also contemplated that the apparatus according to the invention could also function without a control device 55 for the controlled raising-apart of the rollers of the conveying-roller pair.

Furthermore, it is also contemplated that the printed products could be fed to the receiving compartments, and introduced into the conveying gap of the relevant conveying-roller pair, by a clamp conveyor that has individually controllable clamps, that are arranged one behind the other on a circulating drawing member, for retaining and transporting each of the printed products.

It is intended that the accompanying Drawings and foregoing detailed description is to be considered in all respects as illustrative and not restrictive, the scope of the invention is intended to embrace any equivalents, alternatives, and/or modifications of elements that fall within the spirit and scope of the invention, and all changes which come within the meaning and range of equivalency of the claims are therefore intended to be embraced therein.

I claim:

1. An apparatus for processing printed products, comprising:

receiving compartments that are driven in rotation along a continuous movement path, said receiving compartments arranged one behind the other;

wall elements extending transverse to the direction of rotation of said receiving compartments, said receiving compartments being delimitted by said wall elements;

each receiving compartment including an opening located on the outside with respect to the continuous movement path and through which printed products can be inserted into the receiving compartments;

a belt conveyor for feeding printed products, said belt conveyor including a discharge end that said openings of the rotating receiving compartments are adapted to move past such that a printed product can be fed from the discharge end, through the opening into a receiving compartment with its leading edge first;

a conveying-roller pair provided adjacent said opening of each receiving compartment, said conveying-roller pair forms a conveying gap said conveying-roller pair including a driven roller; and said conveying-roller pair, when moving past said discharge end of the belt conveyor, receiving between its rollers one fed printed product and clamping said printed product in said conveying gap and then conveying the firmly clamped printed product into the receiving compartment.

2. The apparatus as claimed in claim 1, wherein, said conveying-roller pair has a pressing-on position at which said rollers are pressed towards one another and a raised-up position at which said conveying gap is open, such that before the conveying-roller pair is moving past the discharge end of the belt conveyor, the two rollers are moved apart from one another out of their pressing-on position by means of a control device and are moved back into the pressing-on position when the trailing roller of said two rollers moves past the discharge end.

3. The apparatus as claimed in claim 2, wherein a first roller of the conveying-roller pair is rotatably mounted at the outer edge of the trailing wall element with respect to the direction of rotation path, a spring for pre-stressing the second roller, of the conveying-roller pair, toward said first roller, into the pressing-on position, and said control device functions to move said second roller, in the direction of the leading wall element of said receiving compartment, into the raised-up position.

4. The apparatus as claimed in claim 3, wherein the second roller is mounted on a bearing lever that is pivotally mounted on a wall element, and said control device includes a control lever that functions in cooperation with said bearing lever and interacts with a stationary control guide for controlling the position of the second roller.

5. The apparatus as claimed in claim 4, wherein the bearing lever is spring-loaded in the pressing-on direction, and the control guide acts counter to the spring action.

6. The apparatus as claimed in claim 3, wherein said first roller is driven.

7. The apparatus as claimed in claim 1, wherein the receiving compartments are arranged in the manner of a drum formed around a common axis of rotation, and wherein adjacent receiving compartments are separated from one another by a common wall element.

8. The apparatus as claimed in claim 7, wherein the discharge end of the belt conveyor is located on the side of a vertical plane passing through the axis of rotation, at which the receiving compartments move in the direction from bottom to top, and the belt conveyor is arranged to feed the printed products in an imbricated formation in which each printed product rests on the respectively following printed product.

9. The apparatus as claimed in claim 1, wherein a stop is provided at the discharge end of the belt conveyor, against which said leading edges of the printed products come to rest, a suction arrangement including a suction head that functions to grasp a printed product that is resting against the stop, on its free flat side, raise the printed product over the stop and discharge the printed product between the rollers with said leading edge in front.

10. The apparatus as claimed in claim 7, wherein the discharge end of the belt conveyor is located on the side of a vertical plane passing through the axis of rotation, at which the receiving compartments move in the direction from top to bottom, and the belt conveyor is arranged to feed the printed products in an imbricated formation in which each printed product rests on the respectively following printed product.

11. The apparatus as claimed in claim 1, that includes a plurality of belt conveyors, having discharge ends, that are arranged one behind the other as seen in the direction of rotation, such that a plurality of printed products are successively fed to a receiving compartment.

12. The apparatus as claimed in claim 1, wherein a feeding station is arranged downstream of the belt conveyor, which feeding station deposits an additional folded printed product in a straddling manner onto the printed products located in the receiving compartment.

* * * * *